United States Patent [19]

Tartt et al.

[11] Patent Number: 4,637,076

[45] Date of Patent: Jan. 20, 1987

[54] CONVERTIBLE VEST-BAG

[76] Inventors: Evangeline Tartt, 4916 Imperial, Bellaire, Tex. 77401; Sandra Webber, P.O. Box 161, Farmington, Me. 04938

[21] Appl. No.: 755,340

[22] Filed: Jul. 16, 1985

[51] Int. Cl.[4] ..... A41D 1/04; A41D 15/00; A45C 9/00

[52] U.S. Cl. ..... 2/102; 2/94; 2/209.1; 190/107; 224/151

[58] Field of Search ..... 2/102, 209.1, 72, 86, 2/69, 69.5, 89, 213, 94, 95, 103; 190/107; 294/141; 224/151, 205

[56] References Cited

U.S. PATENT DOCUMENTS

| | | | |
|---|---|---|---|
| 796,711 | 8/1905 | Ferguson | 2/94 |
| 1,307,244 | 6/1919 | Cox | 2/94 |
| 1,520,962 | 12/1924 | North | 2/102 |
| 2,257,935 | 10/1941 | Blagden | 2/94 |
| 3,470,567 | 10/1969 | Dellaguzzo | 2/102 |
| 3,818,158 | 6/1974 | Nakanishi | 2/209.1 X |
| 4,475,251 | 10/1984 | Hopkins | 2/94 |
| 4,483,469 | 11/1984 | Arisland | 2/102 X |

FOREIGN PATENT DOCUMENTS

| | | | |
|---|---|---|---|
| 83742 | 7/1935 | Sweden | 2/102 |

*Primary Examiner*—Werner H. Schroeder
*Assistant Examiner*—Andrew M. Falik
*Attorney, Agent, or Firm*—Kenneth A. Roddy

[57] ABSTRACT

A vest-bag which is convertible between a vest garment configuration and a bag configuration comprises a unit of flexible material such as leather having a lower portion sectioned into laterally contiguous rectangular panels forming open ended pockets having a series of eyelets extending vertically near the longitudinal sides of the contiguous rectangular panels and an upper portion extending upwardly from the lower portion and divided into a central back panel and a pair of side panels having snap fasteners at the upper ends. The side panels may be fastened to the back panel to form a vest bodice for wearing the vest-bag in a vest garment configuration. The back panel and one side panel may be folded onto the contiguous panels which may then be folded one upon another and releasably connected by a lace member passing through the eyelets to form a bag configuration. A carrying strap extends from the vest-bag in the folded position for carrying the bag.

18 Claims, 9 Drawing Figures

CONVERTIBLE VEST-BAG

BACKGROUND OF THE INVENTION

1. Field of the Invention

This invention relates generally to folding garments and bags, and more particularly to a vest-bag which is convertible between a vest garment configuration and a bag configuration.

2. Brief Description of the Prior Art

Convertible vests and bags are known in the art. There are several patents which disclose various folding garment and bag constructions.

Lapham, U.S. Pat. No. 1,879,341, discloses a vest having pockets, an attachable neck strap, and straps which extend around the waist and are tied to prevent the vest from shifting. The Lapham vest is designed to support a rod and reel and does not suggest a vest which is foldable or convertible to a hand or shoulder bag configuration.

Buck, U.S. Pat. No. 2,620,479, discloses a sportsman's garment consisting of an outer jacket and a harness disposed within and separably attached to the jacket. The jacket may be removed and the harness worn under a conventional coat or jacket. The jacket comprises a rear section and a pair of front sections having their side edges spaced from the rear section and separably connected thereto by transverse adjustable bands.

Altick, U.S. Pat. No. 2,864,541, discloses a shell retainer and dispenser comprising in its modified form, elongated containers which are fastened to a hunting vest.

DeSpain, U.S. Pat. No. 3,848,267 discloses a vest type garment having utility as a balanced carrier and as a pair of matched seat cushions. The garment comprises two identical front and back vest sections each having a large pocket which when worn, are snapped together over the shoulders. The large pockets are used for transporting beverages or other articles in a balanced load divided between the front and rear pockets. A removable cushion may be placed in the pocket and the neck portions of the garment folded around the pocket to form a seat cushion.

Arisland, U.S. Pat. No. 4,483,469 discloses a convertible carrier bag worn beneath a coat or jacket in a body support configuration and convertible to a hand support configuration. The construction of the Arisland patent is quite different than the present invention. The Arisland patent comprises a vest and a pair of pouches or purse segments. The pouches are connected one at the lower edge of each front panel of the vest and straped to the wearer to reside inconspicuously close to the abdomen similar to a money belt. The pouches may be releasably connected by a zip fastener along juxtaposed edges so that they may be secured together in a face to face relationship to provide a garment storage compartment therebetween which may accomodate the vest. Tie straps extend from opposite ends of each pouch to the back edge of the adjacent shoulder strap and around the front of the wearer to be connected by a buckle fastener to retain the carrier bag on the wearer.

The prior art in general, and none of these patents in particular, disclose the present vest-bag convertible between a vest garment configuration and a bag configuration which comprises a unit of material having a lower portion sectioned into laterally contiguous rectangular panels forming open ended pockets having vertically spaced fasteners along their longitudinal sides, and an upper portion extending upwardly from the lower portion and divided into a central back panel and a pair of side panels having snap fasteners at the upper ends. The side panels may be fastened to the back panel to form a vest bodice for wearing the vest-bag in a vest garment configuration. The back panel and one side panel may be folded onto the contiguous panels which may then be folded one upon another and releasably connected by the vertically spaced fasteners to form a bag configuration. A carrying strap extends from the vest-bag in the folded position for carrying the bag.

SUMMARY OF THE INVENTION

It is therefore an object of the present invention to provide an attractive multi-use vest-bag which may be worn as a vest garment and easily converted to a shoulder bag configuration when desired.

Another object of this invention is to provide a convertible vest-bag having ample storage compartments for comfortably carrying purse articles, eliminating the need to carry a purse and leaving the hands free while wearing the vest.

Another object of this invention is to provide a convertible vest-bag having fashion appeal for both men and women.

Another object of this invention is to provide a convertible vest-bag which is attractive in appearance, simple in construction, easily manufactured, and rugged and durable in use.

Other objects of the invention will become apparent from time to time throughout the specification and claims as hereinafter related.

The above noted objects and other objects of the invention are accomplished by a vest-bag convertible between a vest garment configuration and a bag configuration comprising a unit of material having a lower portion sectioned into laterally contiguous rectangular panels forming open ended pockets and a series of vertically spaced fasteners near the longitudinal sides of the contiguous rectangular panels, and an upper portion extending upwardly from the lower portion and divided into a central back panel and a pair of side panels having snap fasteners at the upper ends. The side panels may be fastened to the back panel to form a vest bodice for wearing the vest-bag in a vest garment configuration. The back panel and one side panel may be folded onto the contiguous panels which may then be folded one upon another and releasably connected by the vertically spaced fasteners to form a bag configuration. A carrying strap extends from the vest-bag in the folded position for carrying the bag.

DESCRIPTION OF THE PREFERRED EMBODIMENT

Figure 1:
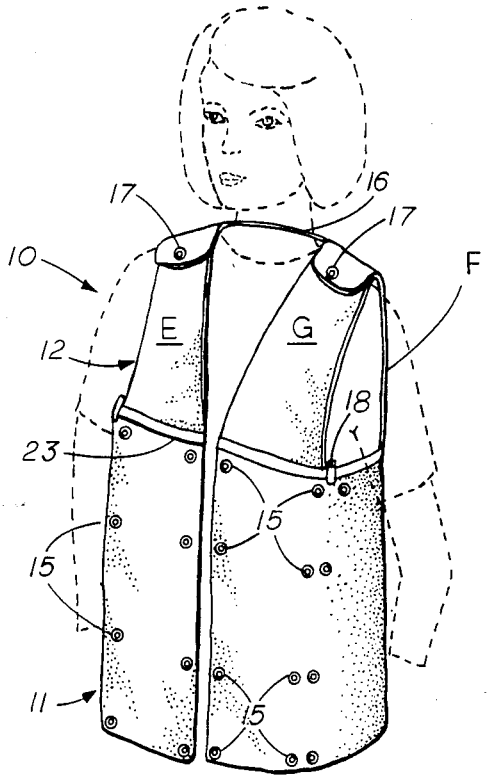
FIG. 1 is a front pictorial view of the convertible vest-handbag in accordance with the present invention in use as a vest.

Referring to the drawings by numerals of reference, there is shown a preferred convertible vest-bag 10 constructed from soft flexible material such as leather, cloth, or vinyl. The vest-bag 10 comprises a single unit having a lower portion 11 and an upper portion 12. The lower portion 11 is a double ply of material sectioned into contiguous rectangular panels A, B, C, and D. Panels A and D extend laterally outward from the inner panels B and C. The plys forming the panels are joined by bottom stitching 13 along the entire bottom of the vest-bag and side stitching 14 along the side edges of panels A and D.

A series of eyelets 15 are secured through the plys laterally to each side of the side stitching 14 in a vertically spaced relation. Two laterally spaced parallel rows of vertically spaced eyelets 15 are secured through the plys intermediate the side stitching 14. The plys are open at the top on a line defining the intersection between the upper and lower portions. In this manner, the lower portion is formed into four large rectangular pockets.

Figure 3:
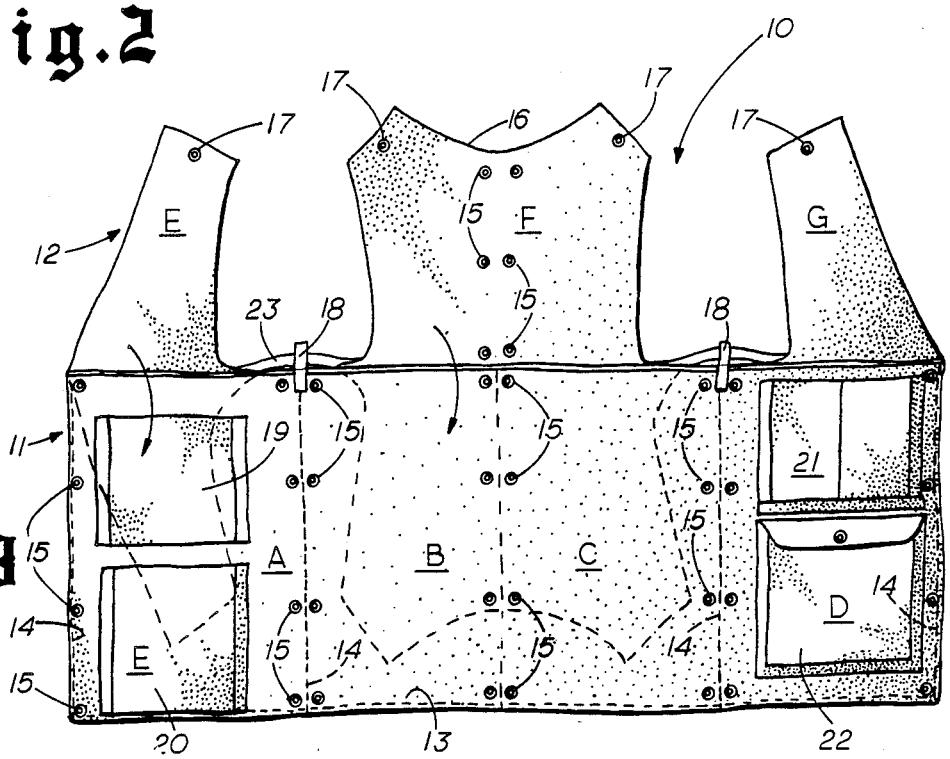
FIG. 3 is a plan view of the interior side of the vest-bag.
Figure 4:
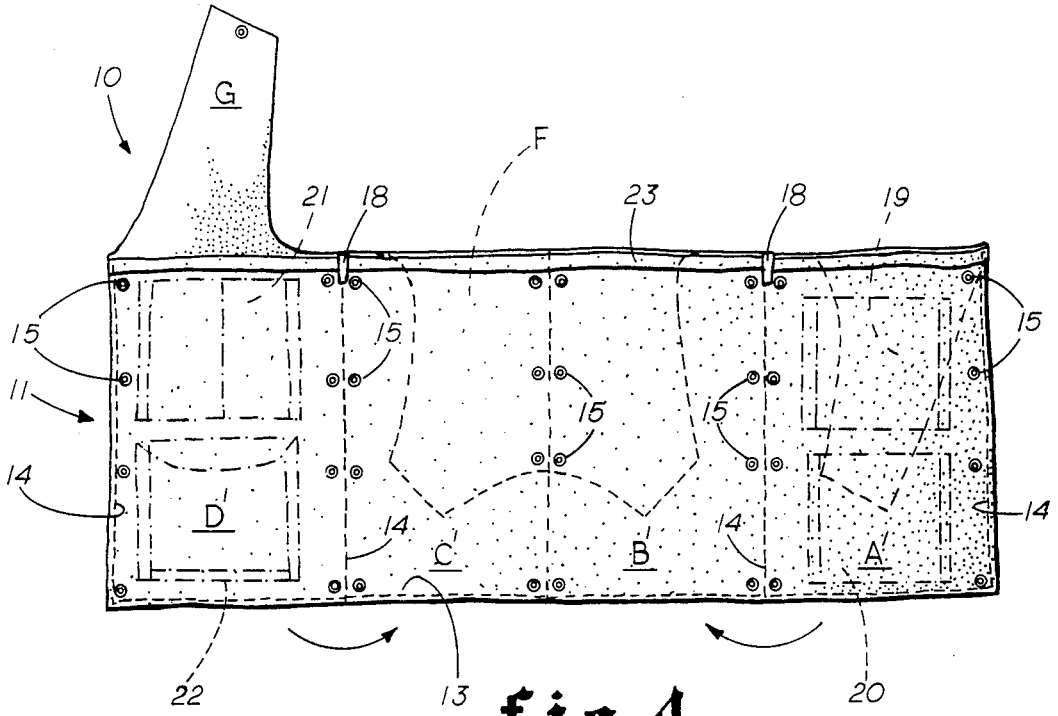
FIG. 4 is a plan view of the exterior side of the vest-bag.

FIG. 3 shows the interior side of the vest-bag 10, and FIG. 4 shows the exterior side. For ease of understanding, the panels on the interior side of the lower portion of the vest-bag are designated as A, B, C, and D, and when the vest is turned over to illustrate the exterior side, the panels are designated A', B', C', and D'.

A single ply of the material extends upwardly from the double ply lower portion 11 above the open top ends of the large pockets to form the upper portion 12. The upper portion 12 is divided into a pair of side panels E and G which are spaced laterally from a central back panel F. The top of the back panel F may be provided with a generally U-shaped cut-out collar portion 16 to fit the neck of the wearer. Two laterally spaced parallel rows of vertically spaced eyelets 15 are secured through the single ply back panel F in vertical continuation of the eyelets of the lower portion.

Figure 7:
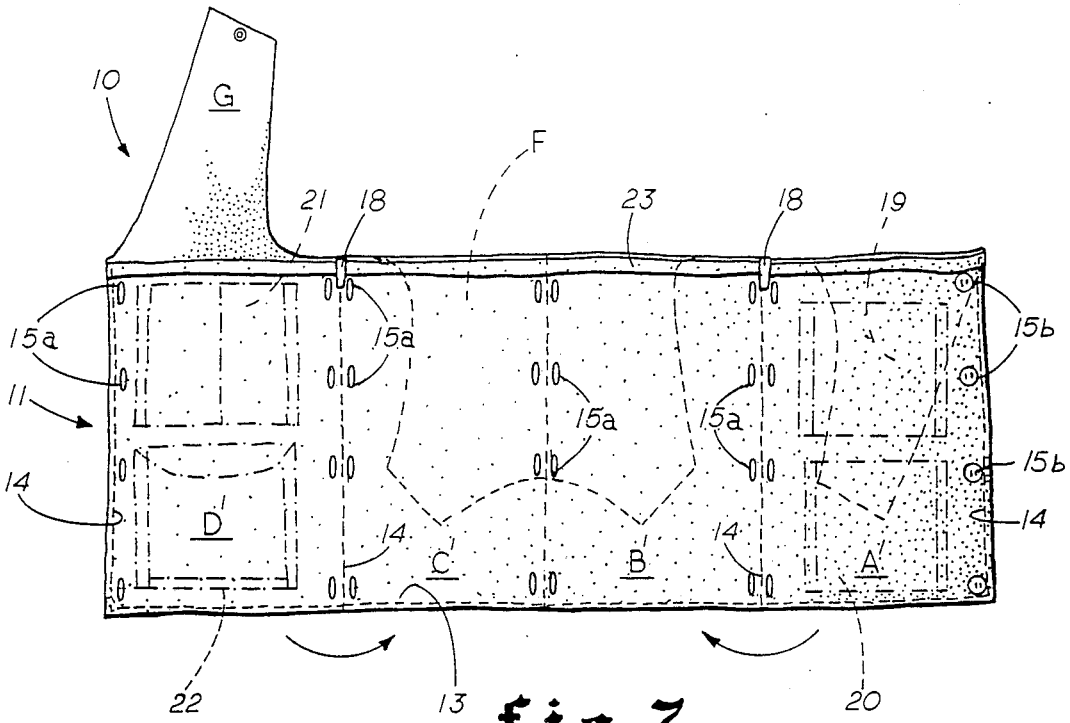
FIG. 7 is a plan view similar to FIG. 4 of a convertible vest-bag having button holes and button fasteners.
Figure 8:
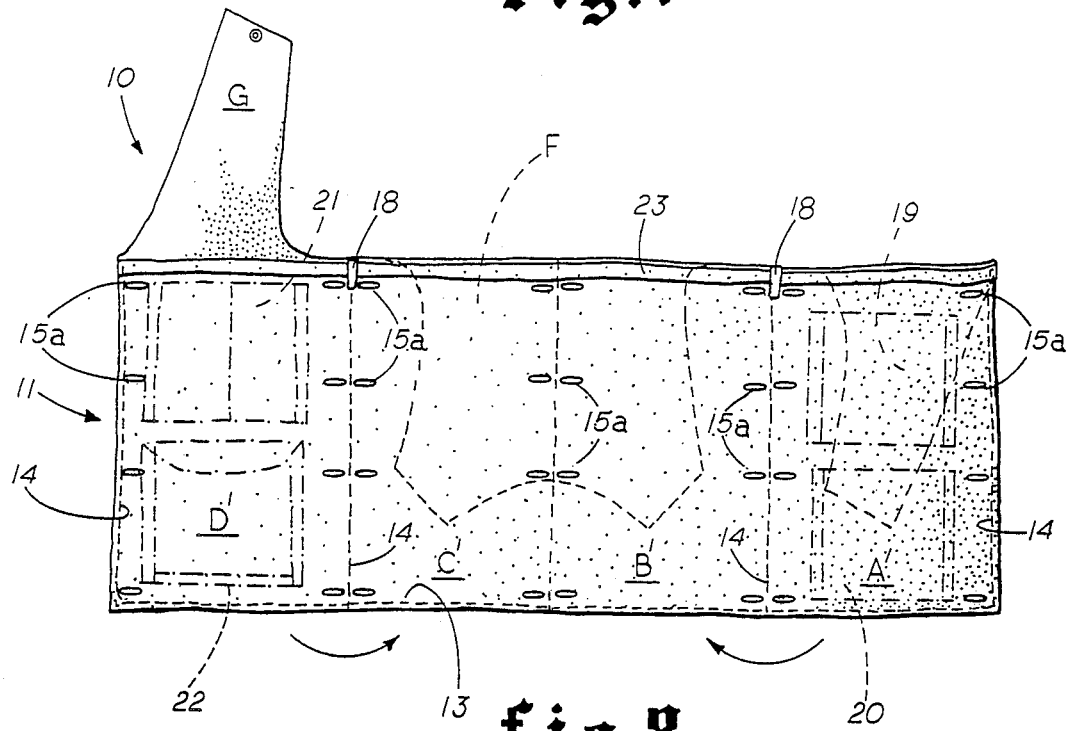
FIG. 8 is a plan view similar to FIG. 4 of a convertible vest-bag having button holes to receive cuff link fasteners.
Figure 9:
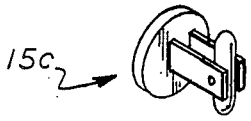
FIG. 9 is an isometric view of a cuff link fastener.

The spacing of all the eyelets 15 is such that when the vest-bag is folded, as hereinafter described, they will be superposed one upon another in vertical rows. It should be understood that other fastener means such as button holes 15*a* and button 15*b* (FIG. 7) or cuff links 15*c* (FIGS. 8 and 9) may be substituted for the eyelets without departing from the scope of the present invention. It should also be understood that the back panel may be provided with a substantial cut-out or recess extending to the lower portion for various vest styles and to accomodate various other types of fasteners.

Fastener means such as snap fasteners 17 are secured near the top edges of the side panels E and G and the back panel F adjacent the collar portion 16, a pair of loops 18 extend upwardly above the lower portion 11 between the back panel F and side panels E and G.

A pair of pockets 19 and 20 are sewn onto the interior ply of panel A in a vertically spaced relation, and a pair of pockets 21 and 22 are sewn onto the interior ply of panel D in a vertical spaced relation. The pockets may be of any conventional design and may be provided with flaps and fasteners.

It should be understood that additional pockets may also be provided on the exterior plys of the panels and would be visible on the exterior surface after folding, however none are shown to avoid confusion in the illustration of the folding sequence. Breast pockets could also be provided on the side panels.

FIG. 4 shows the exterior side of the vest-bag 10. The loops 18 are adapted to fold to either side of the vest-bag 10. An elongate strap 23 is slidably received in the loops 18 and secured at each end to the outermost sides of the panels A' and D'.

OPERATION

Referring now to FIGS. 3, 4, 5, and 6, the folding operation will be explained. When worn as a vest as shown in FIG. 1, the snap fasteners 17 at the top edges of the side panels E and G are fastened to the snaps at the top edges of the back panel F to form a vest bodice. The vest is then simply put on and worn as a coventional vest. Depending upon the type of material used, the vest may be worn with either the interior side out (pockets showing) or the exterior side out (no pockets showning). Loose fasteners may be conveniently carried in a pocket. In the embodiment illustrated, a lace 24 is used with the eyelets.

Figure 2:
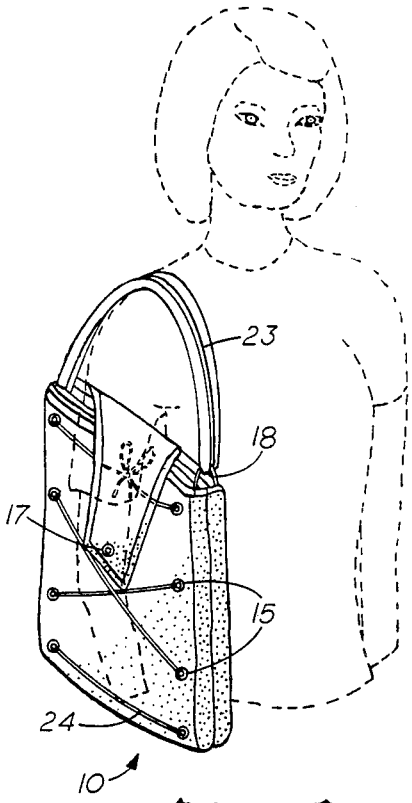
FIG. 2 is a front pictorial view of the convertible vest-handbag in use as a shoulder bag.

When desired, the vest-bag 10 may be folded to an attractive bag configuration to be carried on the shoulder as shown in FIG. 2. The snap fasteners 17 are unfastened, and the vest-bag 10 is laid out flat as shown in FIG. 3.

As shown in FIG. 3, the back panel F is folded over the interior side onto the panels B and C. One of the side panels E (for example) is folded over the interior side onto the panel A. The top portion of the side panel E could also be placed inside the pocket 20.

Figure 5:
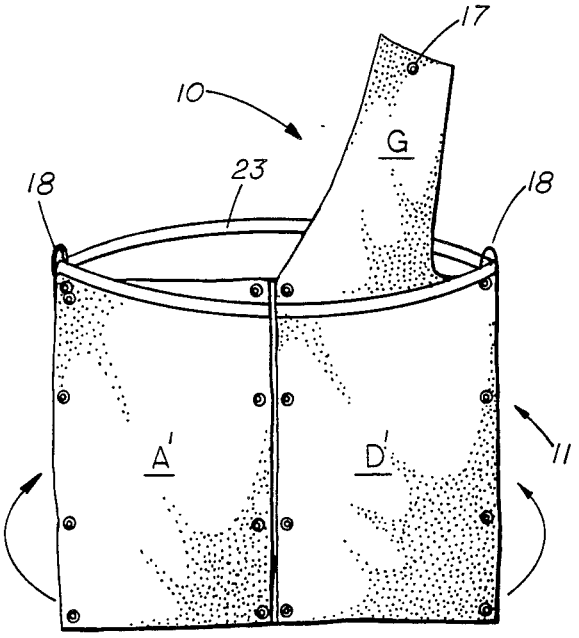
FIGS. 5, and 6 are plan views of the convertible vest-handbag illustrating in combination with FIGS. 3 and 4, the folding sequence in the conversion from vest to bag.

Panel A is folded onto panel B and panel D onto panel B with the eyelets 15 in alignment. This leaves panels A' and D' outward as shown in FIG. 5.

Figure 6:
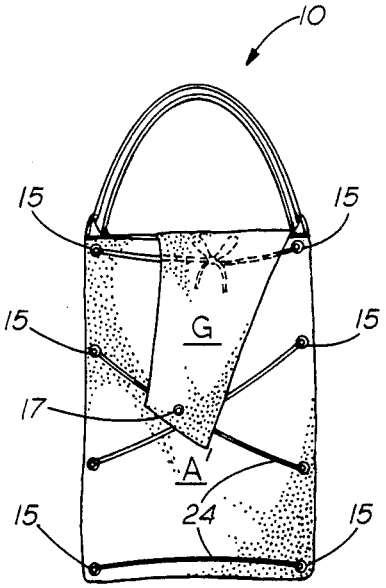

Panels A' and D' are folded back and the strap 23 is pulled up. This leaves panel A' facing outward on one side and panel D' facing outward on the other side. All of the eyelets are aligned, and each end of lace 24 is inserted through the lowermost eyelets. The lace 24 is passed through the remaining eyelets in any suitable pattern, such as crossing over as shown in FIG. 6 and then tied, and finally panel G is folded over panel A'. It should be understood that additional snaps or fasteners could be installed on the outer panels for securing the side panels if desired.

Panels A' and D' may also be folded forward in a face-to-face relation, in which case only one longitudinal side of the folded vest-bag need be secured by the lace.

When properly folded, the vest-bag 10 may be supported on the shoulder of the wearer as shown in FIG. 2. It should be obvious to those skilled in the art that the strap 23 may be modified such that when folded to the bag configuration, a shorter strap is provided for a hand carried bag design.

While this invention has been described fully and completely with special emphasis upon a preferred embodiment, it should be understood that within the scope of the appended claims the invention may be practiced otherwise than as specifically described herein.

We claim:

1. A vest-bag which is convertible between a vest garment configuration and a bag configuration comprising:

a unit of material having a lower portion sectioned into laterally contiguous panels and an upper portion divided into a central back panel and a pair of side panels, said lower portion formed of a multi-ply material wherein each of said contiguous panels forms a pocket with a top opening at the intersection of the upper and lower portions, said lower portion adapted to be secured in a folded condition with said contigious panels folded one upon another, said upper portion extending upwardly from the lower portion forming a vest bodice for wearing said vest-bag in a vest garment configuration and foldable over said lower portion to form a bag configuration capable of being supported on the shoulder, said contiguous panels forming said open ended pockets in the vest garment configuration and defining purse-like divider panels in the folded condition.

2. The vest-bag according to claim 1 further comprising first fastener means secured near the top edges of said side panels and back panel for releasably connecting said side panels to said back panel to form said vest bodice for wearing said vest-bag in a vest garment configuration.

3. The vest bag according to claim 2 further comprising second fastener means secured near the longitudinal sides of said contiguous panels for releasably connecting said contiguous panels after folding them one upon another.

4. The vest bag according to claim 1 further comprising a strap secured to said contiguous panels of said lower portion adapted to extend outwardly from said vest-bag after folding same to form a bag configuration, said strap extending therefrom for carrying said vest-bag in the bag configuration.

5. A vest-bag which is convertible between a vest garment configuration and a bag configuration comprising;

a unit of material having a lower portion and a upper portion, said lower portion sectioned into laterally contiguous panels forming open ended pockets, said upper portion extending upwardly from the lower portion and divided into a central back panel and a pair of side panels, first fastener means secured near the top edges of said side panels and back panel, second fastener means secured near the longitudinal sides of said contiguous panels, and a strap secured to said contiguous panels of said lower portion, said first fastener means releasably connecting said side panels to said back panel to form a vest bodice for wearing said vest-bag in a vest garment configuration, and said contiguous panels foldable one upon another and releasably connected with said second fastener means, said back panel and side panels foldable with said contiguous panels to form a bag configuration, and said strap extending therefrom for carrying said vest-bag in the bag configuration.

6. The vest-bag according to claim 5 wherein said first fastener means comprise snap fasteners.

7. The vest-bag according to claim 5 wherein said second fastener means comprise a series of vertically spaced eyelets and a removable lace member.

8. The vest-bag according to claim 5 wherein said second fastener means comprises a series of button holes and buttons.

9. The vest-bag according to claim 5 wherein said second fastener means comprises a series of button holes and cuff links.

10. The vest-bag according to claim 5 wherein said strap is slidably retained within a pair of loops connected to said lower portion for maintaining said strap against said vest-bag when worn in the vest garment configuration and extensible therefrom for carrying said vest-bag in the bag configuration.

11. The vest-bag according to claim 5 wherein said open ended pockets are formed by sewing said plys of said contiguous panels together at their bottom ends and side edges.

12. The vest-bag according to claim 5 wherein said open ended pockets are formed by securing said plys of said contiguous panels together at their side edges with fasteners.

13. The vest-bag according to claim 14 wherein said fasteners comprise eyelets.

14. The vest-bag according to claim 5 wherein certain ones of said open ended pockets are formed by sewing said plys of said contiguous panels together and certain other ones of said pockets are formed by securing said plys of said contiguous panels together at their side edges with fasteners.

15. The vest bag according to claim 5 further comprising a plurality of small pockets secured to the outer surface of said contiguous panels.

16. The vest bag according to claim 5 further comprising a plurality of small pockets secured to the other surface of said side panels.

17. The vest bag according to claim 5 wherein said lower portion is a double ply of material.

18. The vest bag according to claim 5 wherein said upper portion is a single ply of material.

* * * * *